US006046964A

United States Patent [19]

Higuchi et al.

[11] Patent Number: 6,046,964

[45] Date of Patent: Apr. 4, 2000

[54] ELECTRONIC TIMEPIECE PROVIDED WITH A CALENDAR

[75] Inventors: Haruhiko Higuchi, Tokorozawa; Hiroyuki Koike, Nerima-ku, both of Japan

[73] Assignee: Citizen Watch Co., Ltd., Tokyo, Japan

[21] Appl. No.: 09/226,828

[22] Filed: Jan. 7, 1999

[30] Foreign Application Priority Data

Jan. 9, 1998 [JP] Japan ..... 10-002819

[51] Int. Cl.[7] ..... G04B 19/24

[52] U.S. Cl. ..... 368/28; 368/34; 368/35

[58] Field of Search ..... 368/28, 29, 31, 368/33, 34, 35, 37

[56] References Cited

U.S. PATENT DOCUMENTS 4,261,046 4/1981 Ono et al. ..... 368/35

4,266,289 5/1981 Nakao ..... 368/35

4,282,592 8/1981 Miyasaka ..... 368/37

4,320,476 3/1982 Rerney ..... 368/28

4,733,384 3/1988 Meister et al. ..... 368/28

5,668,781 9/1997 Jeannet et al. ..... 368/28

*Primary Examiner*—Vit Miska

*Attorney, Agent, or Firm*—Koda & Androlia

[57] ABSTRACT

A switch (201) is conjoined with a hand driving gear train (107) and provided with at least three or more contact groups (203, 204, 205) turned on at least once in each 24 hours. A calendar indicating member is updated according to an order of closing each contact. The matching between the time indicating and the calendar indicating can be accomplished when a user modifies the time display.

8 Claims, 12 Drawing Sheets

ELECTRONIC TIMEPIECE PROVIDED WITH A CALENDAR

BACKGROUND OF THE INVENTION

The present invention relates to means for updating a calendar indication of a hand type timepiece capable to indicate a calendar.

A conventional watch indicating hours often has a date indicating function as an additional function. It is the most fundamental constitution in the ordinary watch to conjoin a gear train for driving the hand which indicates the hours, so as to drive the date indicator caused by a gear operating one round in each 24 hours. However, in such a driving mechanism, as the date indicator is driven in complete synchronization with the gear train of a hour system, the present form of the time indicator indicates a nonexistent date such as the 31st day in a shorter month having loss, than 31 days. As a result, a user must manually modify the date indicator by quick-feed method in each time mentioned above so as: to set to correct date.

It have been variously proposed, for instance in a timepiece system constituted as block diagrams shown in FIG. 10, to automatically remove the non-existent date of the end of the month so as to more consistently indicate the correct date. In FIG. 10, the numeral 101 indicates an oscillating circuit which produces a reference signal, the numeral 102 indicates a frequency dividing circuit, the numeral 103 is a driving circuit A, the numeral 104 is a driving circuit B, the numeral 105 is a motor A for driving the hands, the numeral 106 is a motor B, the numeral 107 is a hands driving gear train, the numeral 108 is a date indicator driving gear train, the numeral 109 is a 24 hours switch, the numeral 110 is a hand, and the numeral 112 is a calendar control circuit.

In ordinary time indication, the reference signal OSC produced by the oscillating circuit 101 is divided into a desired frequency dividing signal by the frequency dividing circuit 102 so as to produce, by the driving circuit A, a driving signal DRV1 required to drive the motor A. The hand is driven by the driving signal DRV1 so that ordinary time indication is carried out.

Furthermore, in addition to the motor and the gear train for driving the hand, the driving circuit B, the motor 106 and the gear train 108 for driving the date indicator 111 are provided to control a driving operation of the date indicator 111, independent of the drive operation of the hand. The driving operation of the date indicator is performed on the basis of a signal 24SW from the 24 hour switch.

An example of the 24 hour switch 109 comprises, as shown in FIG. 11, a 24 hour wheel 201 and a contact 202, the 24 hour wheel 201 circuits once every 24 hour and is connected to a Vdd potential which is in the state of a high (hereinafter referred to as "H") level. When the 24 hour wheel 201 is conjointly rotated with the hand driving gear train and close the contact 202, the potential of the contact 202 forms the "H" level and is output as the signal 24SW.

Moreover, in FIG. 10, the 24 hour switch 109 is conjoined to the hand driving gear train and outputs the signal 24SW as an ON signal every 24 hour. On receiving the signal 24SW, the driving circuit B 104 outputs the driving signal DRV2 required to advance the date indicator one day, to the motor B. As a result, the date indicator is advanced by one day during each 24 hour period.

The calendar control circuit 112 contains data on the current day, month, and year. The date advances by one day by the signal 24SW, but the calendar control circuit 112 outputs the non-existent date removing signal DD when the day, month, and year data indicate that the displayed date is non-existent. Upon receiving a signal DD, the driving circuit B106 outputs a driving signal DRV2 required to drive the date indicator by one day.

The non-existent date removing operation of the date indicator is continued until the non-existent state of the date indicator is removed. For instance, in the case of February of a leap year, the date is advanced by two days as soon as the 30th day is indicated. Furthermore, in the case of February of other than a leap year, the date is advanced by three days as soon as the 29th day is indicated. As a result, the date indicator always indicates the correct date.

Since the removing operation of the non-existent date is also automatically carried out in shorter months, a user need not modify the date as conventionally required. On the other hand, according to the conventional example described in the present invention, because the 24 hour switch 109 is conjointly driven to the hand driving gear train, an ON-signal 24SW from the 24 hour switch 109 is output during the time modifying operation of the usual analog timepiece.

In view of the ordinary time modification, the time lag need be corrected less frequently because the accuracy of electronic timepieces has improved. However, it remains necessary to modify the time lag during an overseas trip, or in countries introduced with summer time system.

Essentially, since the user dose not need to modify the date after modifying the time, it is more convenient, that the date indicator be conjointly operated when a user advances or returns the time indicator.

In a typical conventional structure, although the 24 hour switch 109 is turned on in ganged operation with the hand driving gear train 107, each signal 24 SW to be outputted becomes the sane signal in a contact construction shown in FIG. 11, regardless whether the rotative direction of the 24 hour wheel 201 is in the normal or reverse direction in the drawing.

Therefore, in a conventional control wherein the 24 hour switch is turned on in either rotating direction, time modification is carried out by rotating the hand in the reverse (counterclockwise) direction, that is, the time is modified to a returning direction, and the date indicator advances by one day when the 24 hours switch 109 is turned on. Thus, the date indicator lags behind the calendar date.

SUMMARY OF THE INVENTION

An object of the present invention is to solve such time lag problems as in the art described above. The present invention is characterized by an electronic analog timepiece provided with a calendar, comprising: a first motor for driving a time indicating hand; a switch conjoined with a hand driving gear train driven by the first motor, and turned on at least once in each 24 hours; and a calendar indicating member in which indicating is updated based on an ON signal of the switch; wherein the switch is provided with at least three or more contact groups, each contact is closed in each independent timing according to a rotation of the hand driving gear train, and the calendar indicating member is updated in either an advancing direction or a returning direction according to the order each contact is closed.

Thus, the user can have a good feeling in operation, and an electronic timepiece whose time and calendar indicators consistently match is provided.

BRIEF DESCRIPTION OF THE DRAWINGS

The present invention will be described below with the reference to the appended drawings, in which.

DETAILED DESCRIPTION OF THE PREFERRED EMBODIMENTS

The preferred embodiments of the present invention are described in the following with reference to the appended drawings.

Figure 1:
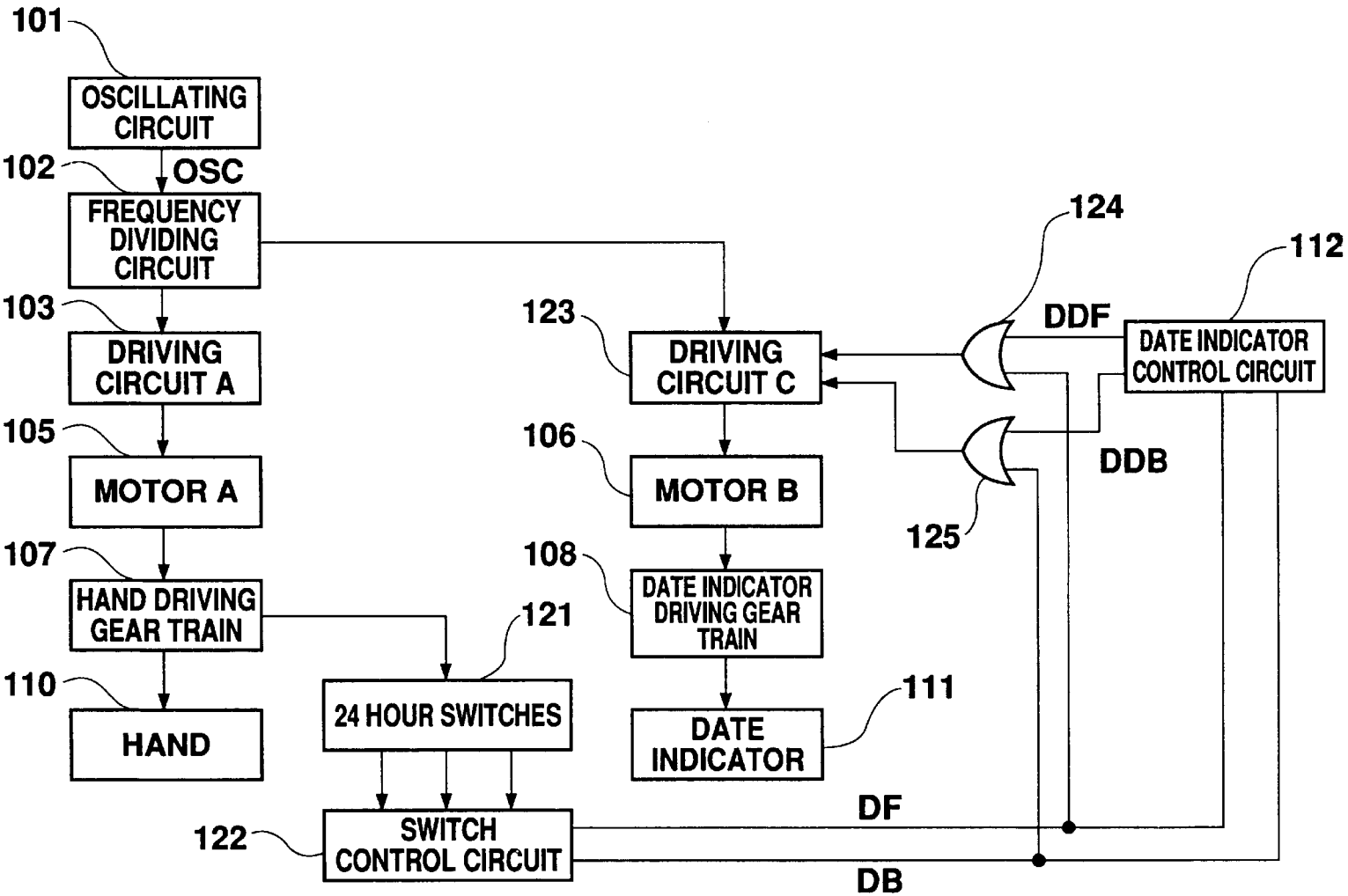
FIG. 1 is a block diagram showing a system structure of timepiece provided with a calendar according to the present invention.

FIG. 1 is a block diagram showing the entire configuration in a first embodiment of the present invention, in which the numeral 123 represents a driving circuit C outputting a driving pulse for driving a motor B 106 either in a normal (clockwise) or in a reverse (counterclockwise) direction according to an input signal, the numeral 121 indicates a 24 hour switch S, which is an improvement of the conventional 24 hour switch, and the numeral 122 is a switch control circuit. Components corresponding to those already described are labeled with the same numerals, and their description will not be repeated. Also, although the mechanism for modifying the hand indication is provided as a component of the present invention, its description and drawing are omitted as the present invention can be accomplished using a conventional mechanism.

Figure 2:
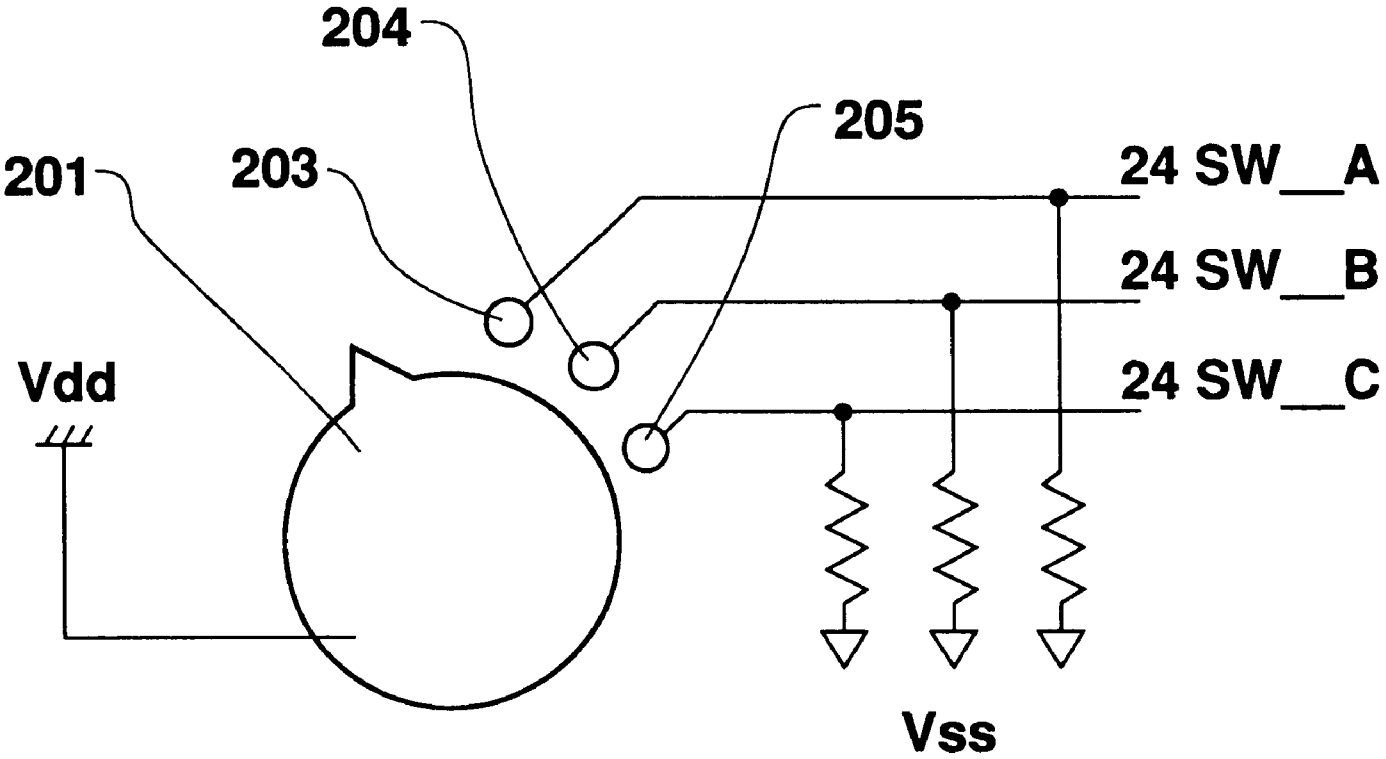
FIG. 2 is a structural diagram showing a 24 hour switch according to the present invention.

FIG. 2 shows an example 24 hour switch S, wherein the numeral 203 indicates a contact A, the numeral 204 is a contact B, and the numeral 205 is a contact C. As a result, the 24 hour wheel 201 is rotated in ganged operation with the hand driving gear train to close those contacts, a signal 24SW_A, a signal 24SW_B, a signal 24SW_C are output respectively.

Figure 3:
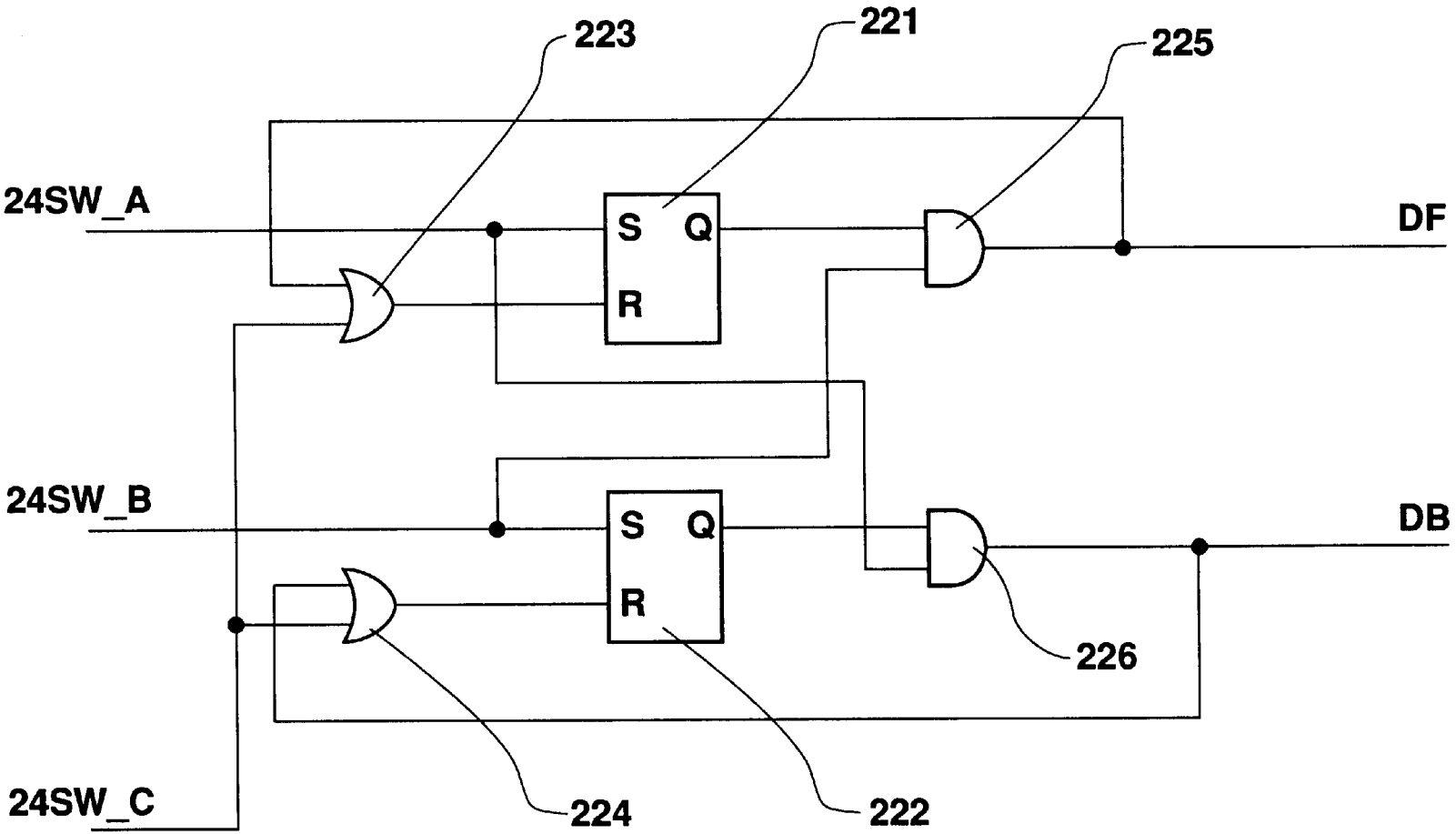
FIG. 3 is a circuit diagram illustrating the structure of a switch control circuit according to the present invention.

Furthermore, FIG. 3 is a circuit diagram showing an internal construction of a switch control circuit 122, wherein 221 and 222 are a SR flip-flop (hereinafter referred to as "SR-FF"), 223 and 224 are an OR circuit, and 224 and 266 are an AND circuit.

Figure 4:
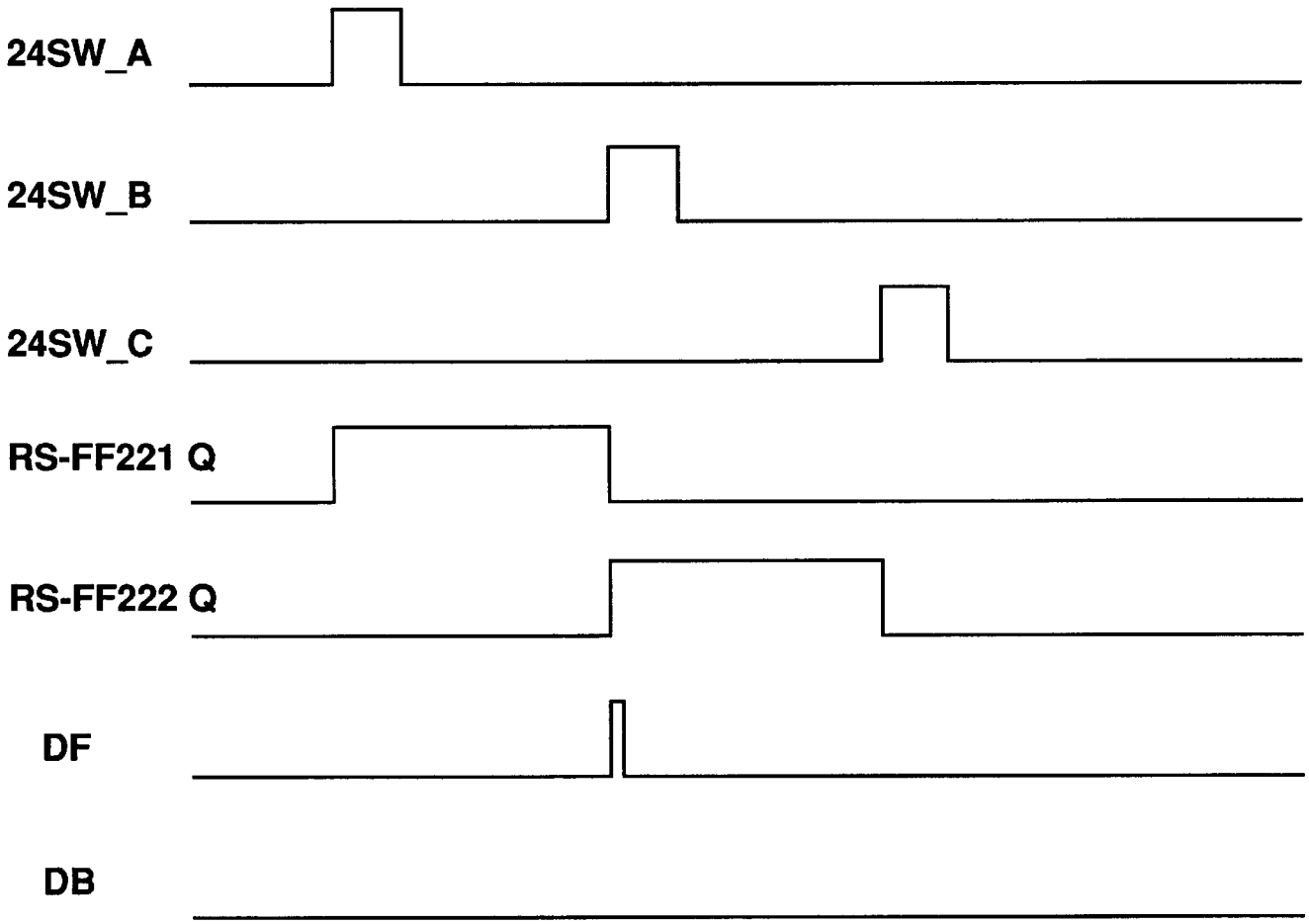
FIG. 4 is a time chart outlining the operation of the normal rotation of the 24 hour wheel in switch control circuit of FIG. 3.

FIG. 4 is a waveform diagram illustrating the 24 hour wheel 201 rotating to allow the contact A 203, the contact B 204, and the contact C 205 to be sequentially input. The operation of the first embodiment of the present invention will be described in the following with reference to the drawings.

Under normal conditions, the hand driving gear train is operated in the same way as in the conventional example, and the hand is driven to indicate the time. The 24 hour wheel 201 is rotated in ganged operation with the hand driving gear train 107. First, when the 24 hour wheel 201 closes the contact A 203, the contact A 203 is connected to the potential of Vdd to allow the signal 24 SW_A to become the "H" level.

When the signal 24 SW_A becomes the "H" level, other signal 24SW_B and signal 24SW_C are retained in the state of a low (hereinafter referred to as "L") level as shown in FIG. 4. Accordingly, the Q output of the SR-FF 221 becomes the "H" level.

When the 24 hour wheel 201 is further rotated as time passes, the 24 hour wheel 201 opens the contact A 203, and then the signal 24 SW_A becomes the "L" level. However, the Q output of the SR-FF 221 is maintained in the "H" level state.

When the 24 hour wheel 201 is further rotated and closes the contact B 204, the signal SW_B becomes the "H" level. As a result, a signal DF for rotating the date indicator in a clockwise direction is output. Upon receiving the signal DF through the OR circuit 124, the driving circuit 123 outputs the driving signal required to rotate the date indicator 111 in the clockwise direction by one day, so that the indicating of the date indicator advances by one day.

In contrast, when retained in the "H" level of the signal 24SW_A, because the Q output of the SR-FF 222 becomes the "H" level and a signal DF becomes the "H" level, a SR-FF 221 is reset and accordingly the Q output becomes the "L" level.

The 24 hour wheel is further rotated to close the contact C 205. When the contact C 205 becomes the "H" level, the SR-FF 222 is reset and, as a result, the Q output of the SR-FF 222 becomes the "L" level.

Under normal conditions, such operations as described above are repeated and the date is updated every 24 hour. On the other hand, when the hand driving gear train 107 is rotated at modifying time by external influence, the 24 hour wheel 201 which is rotated in reverse direction operates as will next be described with reference to the time chart shown in FIG. 5. In the following description, it is assumed that FIG. 6 shows the previous state of starting to rotate the 24 hour wheel in the reverse direction.

Figure 6:
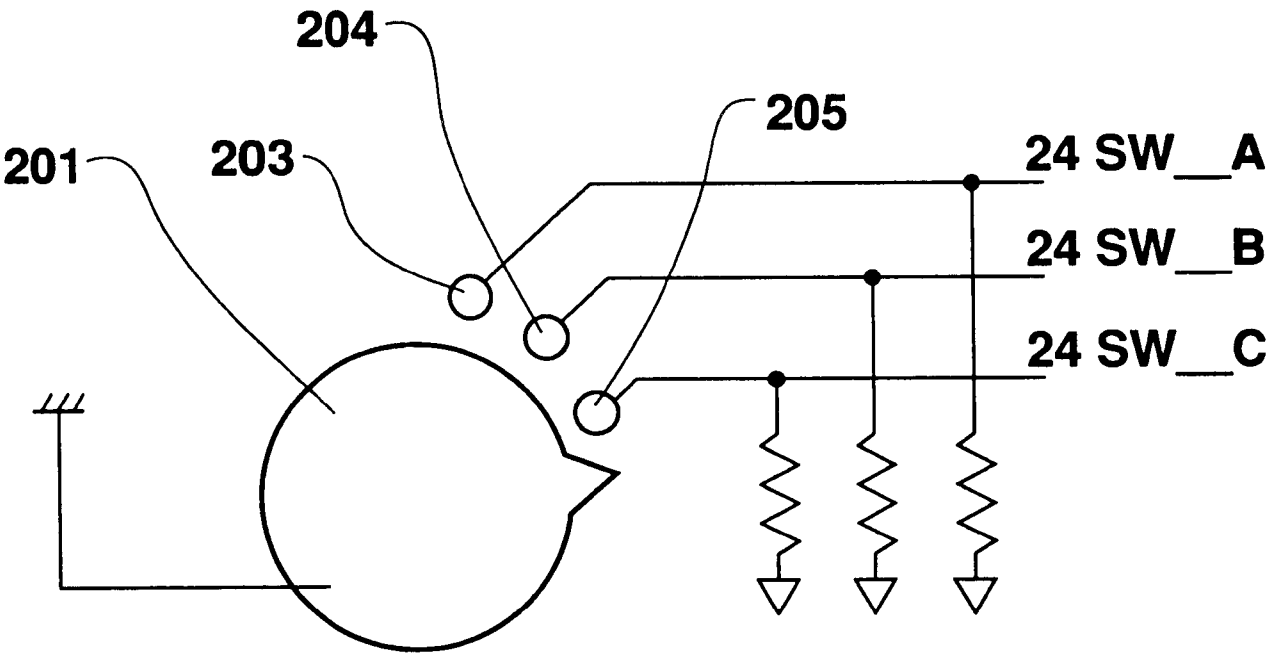
FIG. 6 is a structural diagram showing the reverse rotation state of the 24 hour wheel of FIG. 2.

When the 24 hour wheel 201 is rotated in the reverse directions when the time display is modified, the 24 hour wheel 201 is rotated in the counterclockwise direction in FIG. 6, and the contact C 205 is contacted to the "H" level. In this case, no change occurs because each of the Q output of SR-FF 221 and SR-FF 222 is in an "L" level state from the beginning.

Figure 5:
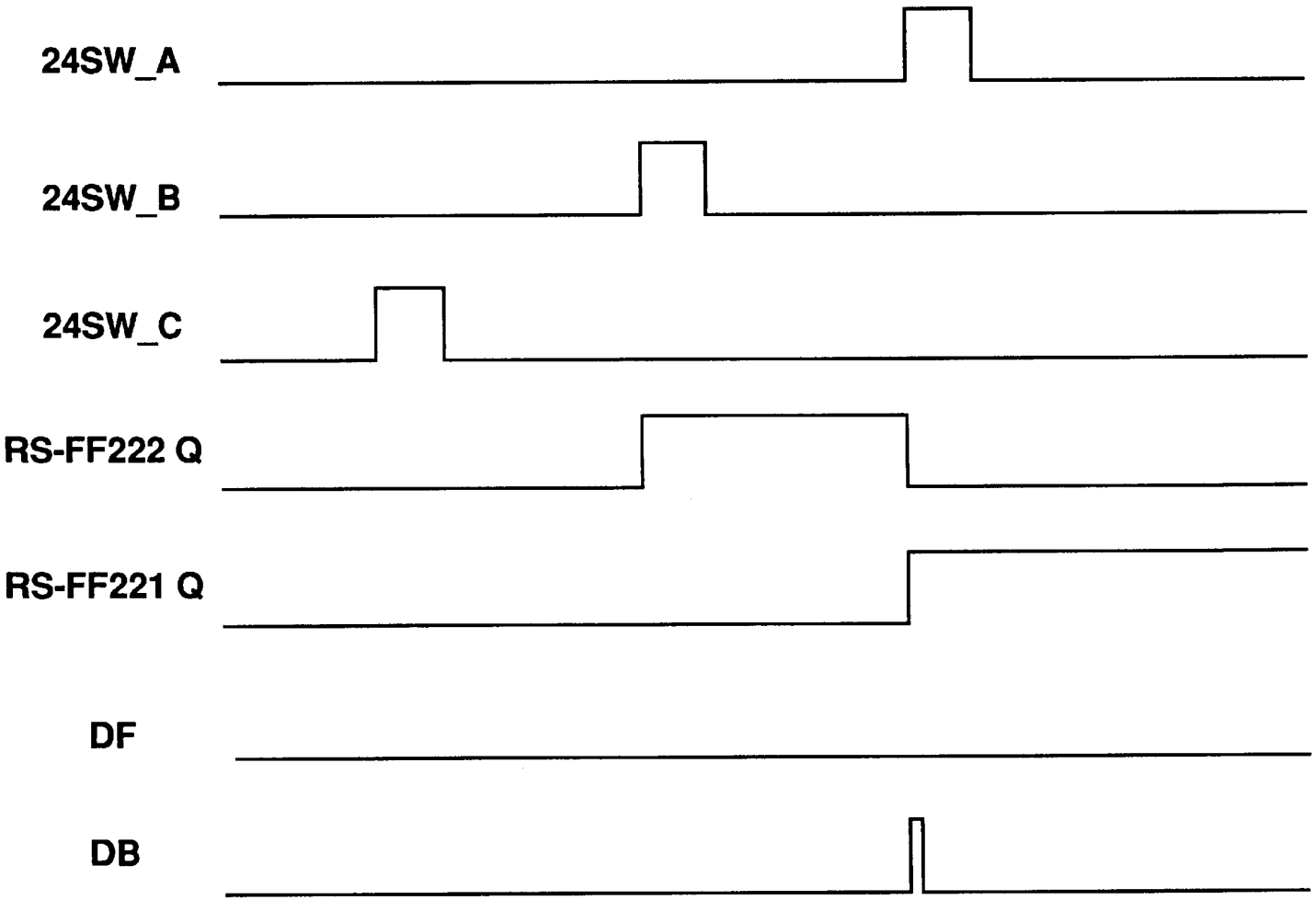
FIG. 5 is a time chart outlining the operation of the reverse rotation of the 24 hour wheel in switch control circuit of FIG. 3.

When the 24 hour wheel 201 is rotated in the reverse direction and then the contact B 204 is connected to the "H" level, the signal 24SW_B becomes the "H" level. In this case, signal 24SW_A and signal 24SW_C are the "L" level state as shown in FIG. 5. Accordingly, the Q output of the SR-FF 222 becomes the "H" level.

When the 24 hour wheel 201 is further rotated in the counterclockwise direction, the 24 hour wheel 201 opens the contact B 204, and then the signal 24SW_B becomes the "L" level. However, the Q output of SR-FF 222 is maintained in the state of the "H" level.

When the 24 hour wheel 201 is further rotated and closes the contact A 203, the signal SW_A becomes the "H" level. As a result, the signal DB for rotating the date indicator in the counterclockwise direction is output. Upon receiving the signal DB, the driving circuit 123 outputs the driving signal required to rotate the date indicator 111 in the counterclockwise direction by one day, so that the indicating of the date indicator is returned by one day.

In contrast, in the state of being retained in the "H" level of the signal 24SW_A, since the Q output of the SR-FF 221 becomes the "H" level and the signal DB becomes the "H" level, the SR-FF 222 is reset and accordingly the Q output becomes the "L" level.

Upon receiving the signal DF from a switch control circuit 122, a date indicator control circuit 112 advances internal information of the day, month, and year by one day. Conversely, upon receiving the signal DB, the date indicator control circuit 112 returns the internal information of the day, month, and year by one day. Accordingly, the date information of the date indicator control circuit 112 is maintained in the corresponding state with the indicating of the date indicator 111.

With respect to control for avoiding indication of non-existent dates in shorter months, the date indicator advances in the same way as described in the conventional example, and its description is not repeated. When the date indicator is turned backward, in other words, the hand driving gear train is rotated in the reverse direction by modifying the time display or so forth, the date indicator indicates a non-existent date as a result of returning the date indicator by one day, for instance, the date indicator 111 may indicate the 31st day of April when the date indicator is returned one day from May 1. At this point, at non-existent removing returning signal DDB is output from a calendar control circuit. Upon receiving the signal DDB though the OR circuit 125, the driving circuit C 123 outputs the driving signal required to return the date indicator by one day.

According to the present invention, under a time modification operation other than the hand 110 being normally driven, in the case where the hand driving gear train is caused to rotate in both normal and reverse directions, the time indication by the hand and the date indication by the date indicator are surely matched.

In this embodiment, the calendar member is described by using the date indicator printed with a date, and, in addition, the date indication is also indicated by the hand. Further, the indicating of the date as well as day of the week as a content of the calendar to be indicated can also be easily accomplished. Furthermore, it is also possible to include a digital display, such as a liquid crystal panel indicating an other calendar.

In this first embodiment of the present invention, the contact A 203, the contact B 204 and the contact C 205 are disposed at an equal space, respectively. When the date indicator is operated on he basis of information input from the 24 hour switch S 121, the important factor of the input timing F is such that each timing the 24 hour wheel 201 closes the contact B 204 in the case of causing the 24 hour wheel to rotate in the normal direction and that the 24 hour wheel 201 closes the contact A 203 in the case of causing the 24 hour wheel to rotate in the reverse direction.

In other words, in the timing of the former, the operation, of the date indicator 111 is advanced by one day, and, in the latter, the operation of the date indicator 111 is returned by one day. When the hand is controlled in the advancing direction, it is also desirable that the indicating of the date indicator be advanced immediately after the time indicator has indicated 12 o'clock midnight. Conversely, when the hand is controlled in the returning direction, it is desired that the indicating of the date indicator be returned by one day immediately after the indicator has passed 12 o'clock midnight in the reverse direction.

However, if there is the space until the 24 hour wheel closes the contact B 204 after closing the contact A 203, for example, if the closing timing between the 24 hour wheel and the contact B 204 is set such timing as indicating 0 in the morning by the hand, the time of the hand 110 at such closing timing in the returning direction is before indication 12 o'clock midnight at the time of closing the 24 hour wheel and the contact A203.

When the 24 hour wheel switch S 121 is constructed as shoots in FIG. 2, it not possible to avoid the operation timing of the date indicator 111 lagging behind the advancing direction of the hand 110 or the timing of the date indicator 111 in the returning direction lagging behind the hand 110. However, this time lag can be minimized by making the space between the contact A 203 and the contact B 204 as narrow as possible.

In contrast, with regard to the contact C 205, as the date indicator is not controlled at all at the timing of allowing the 24 hour wheel 210 to close the contact C 205, the location of the contract C 205 is not limited.

The switches A 203 and B 204 should be as closely together as possible in order to avoid the time lag problems; on the other hand, we have emphasized that a large distance between the contact C 205 and the contacts A 203 and B 204 is advantageous with respect to the manufacturing.

Figure 7:
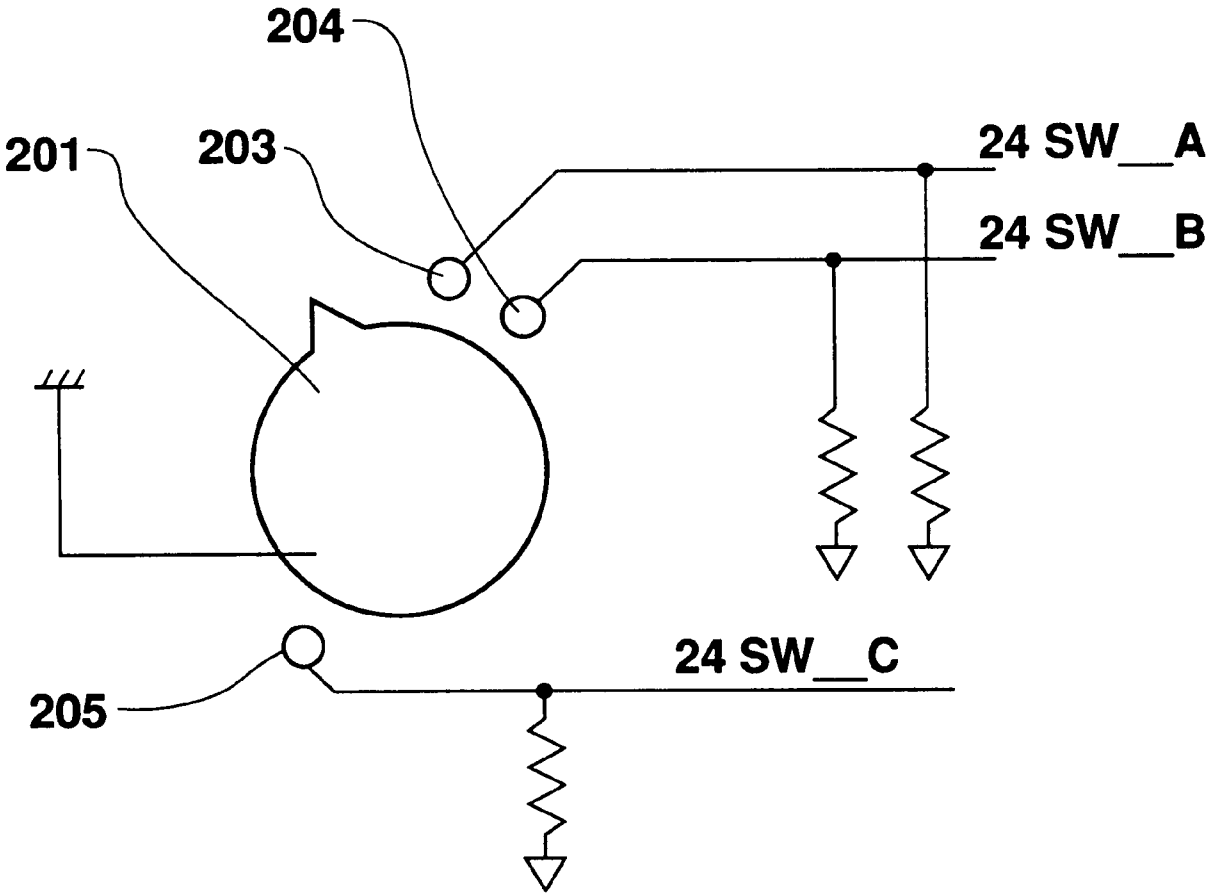
FIG. 7 is a structural diagram showing another 24 hour wheel.

With regard to the location of the plural contacts such as the 24 hour switch S 121, when the space is set broadly in view of interference in the neighbor contact, tolerance is great the device is easy to manufacture. By locating the contact A 203, the contact B 204, and the contact C 205 in such a way as shown in FIG. 7, it is possible to enhance accuracy, without otherwise deteriorating functionality.

In the first embodiment of the present invention, the contact A 203, the contact B 204 and the contact C 205, which are included in the 24 hour switch 121, are connected to the a Vss potential through resistance elements as shown in FIG. 2 so as to prevent the input end from becoming open, when it is not closed with the 24 hour wheel 201.

In the above described contact mechanism, switch current flows from Vdd to Vss through the resistance while the 24 hour wheel 201 closes each of the contacts. In the system in which the timepiece operation must be guaranteed for a long term, such switch current can not be disregarded in light of the long operation tine.

An improvement of the above described 24 hour switch S 121 is carried out in a second embodiment of the present invention. This system, in which unnecessary current flow is stopped and operational life of the timepiece is enhanced, is described in the following.

Figure 8:
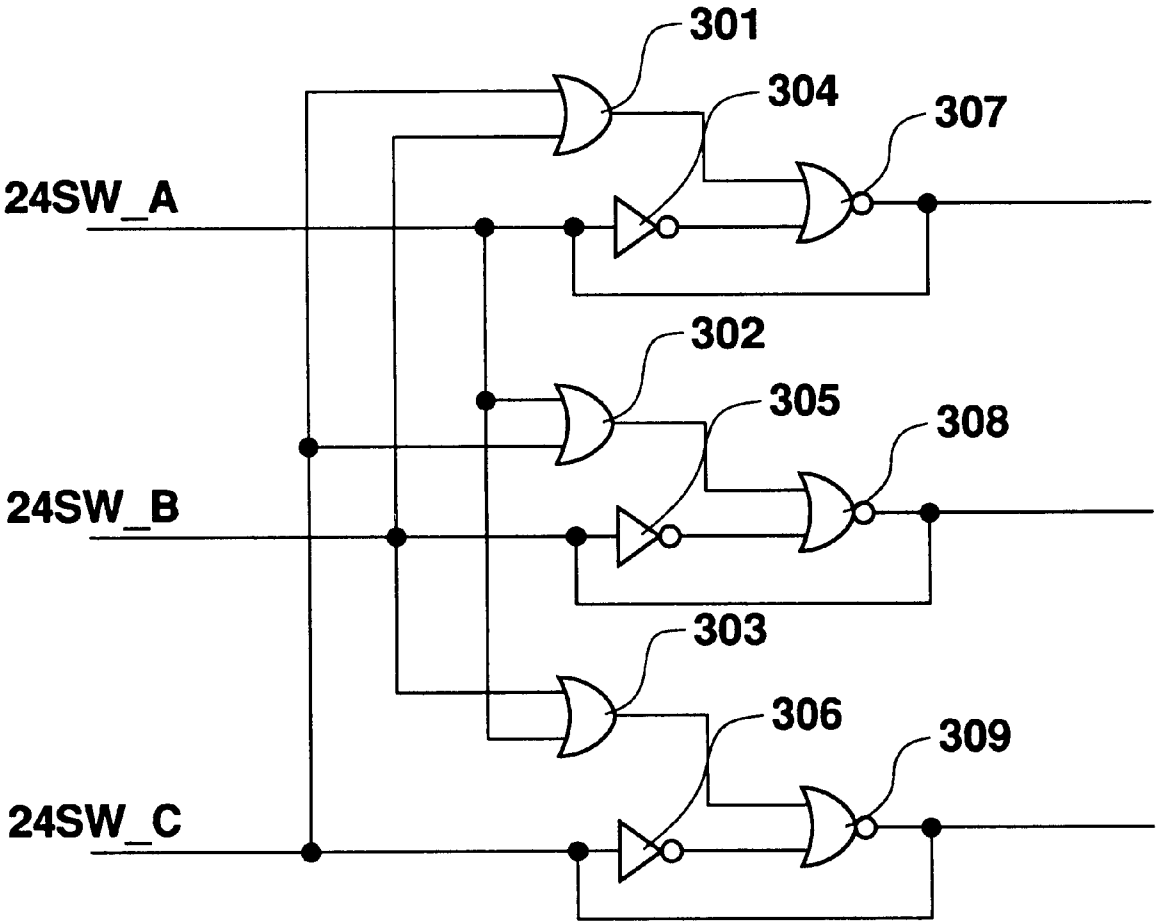
FIG. 8 is a circuit diagram showing a part of switch circuit; according to a second embodiment of the present invention.

FIG. 8 is a circuit diagram showing that part of the switch circuit in the 24 hour switch S 121 shown in FIG. 2 that is improved in the present embodiment. Further, FIG. 9 is a time chart showing the operation of FIG. 8.

In FIG. 8, the numerals 301, 302, and 303 are an OR circuit respectively, the numerals 304, 305, and 306 are a NOT circuit, and the numerals 307, 308, and 309 are a NOR circuit.

In this description, it is assumed that the 24 hour wheel 201 is rotated in the normal direction and closes in order of the contact A 203, the contact B 204, and the contact C 205. Further, in FIG. 9, the signals 24SW_A, 24SW_B, and 24SW_CC present the level of signal shown in FIG. 8, and the signals 24SW_AA, 24SW_BB, and 24SW_CC present such time that the 24 hour wheel 201 closes the contact A 203, the contact B 204, and the contact C 205, respectively.

Figure 9:
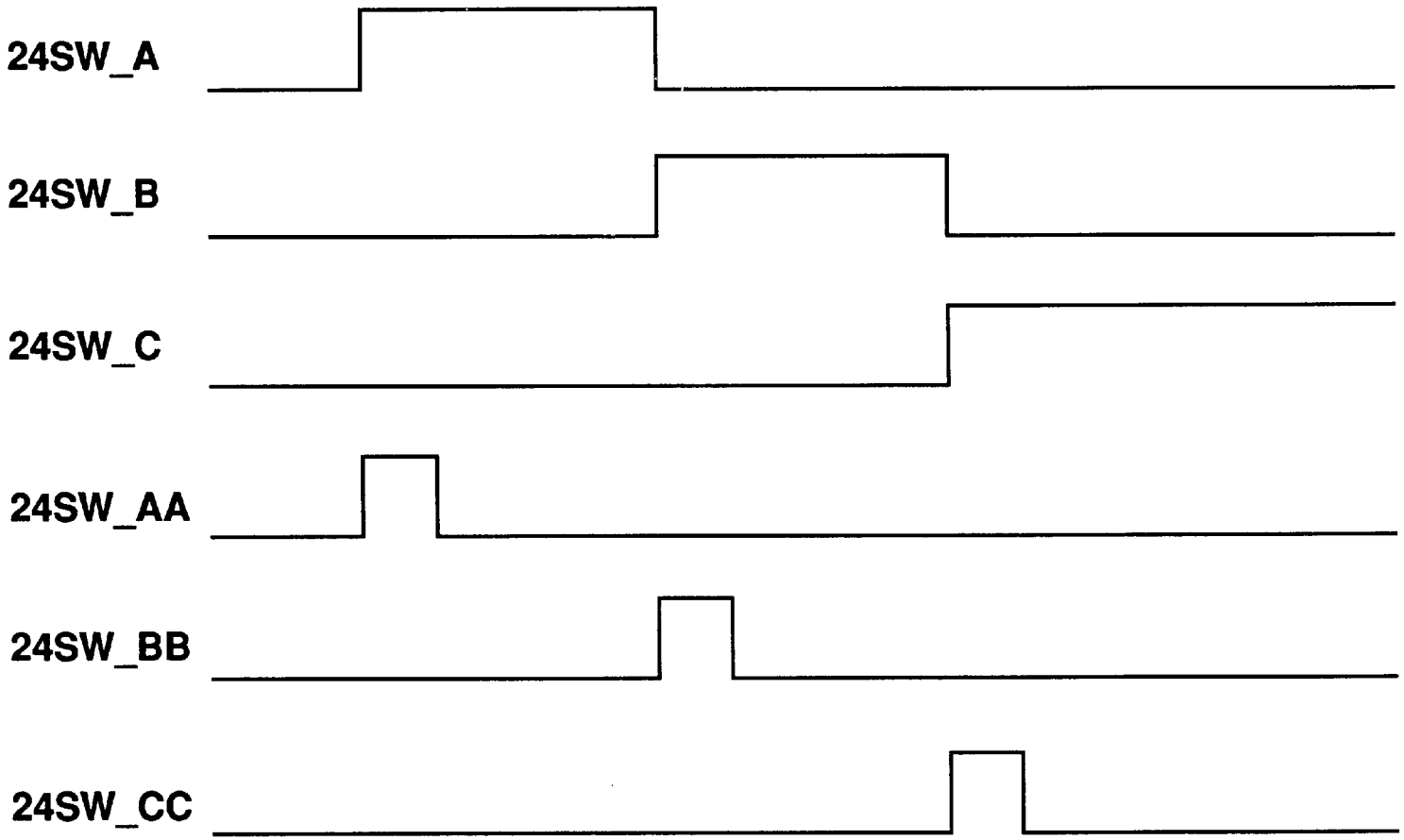
FIG. 9 is a time chart showing the operation of switch circuit: of FIG. 8.
Figure 10:
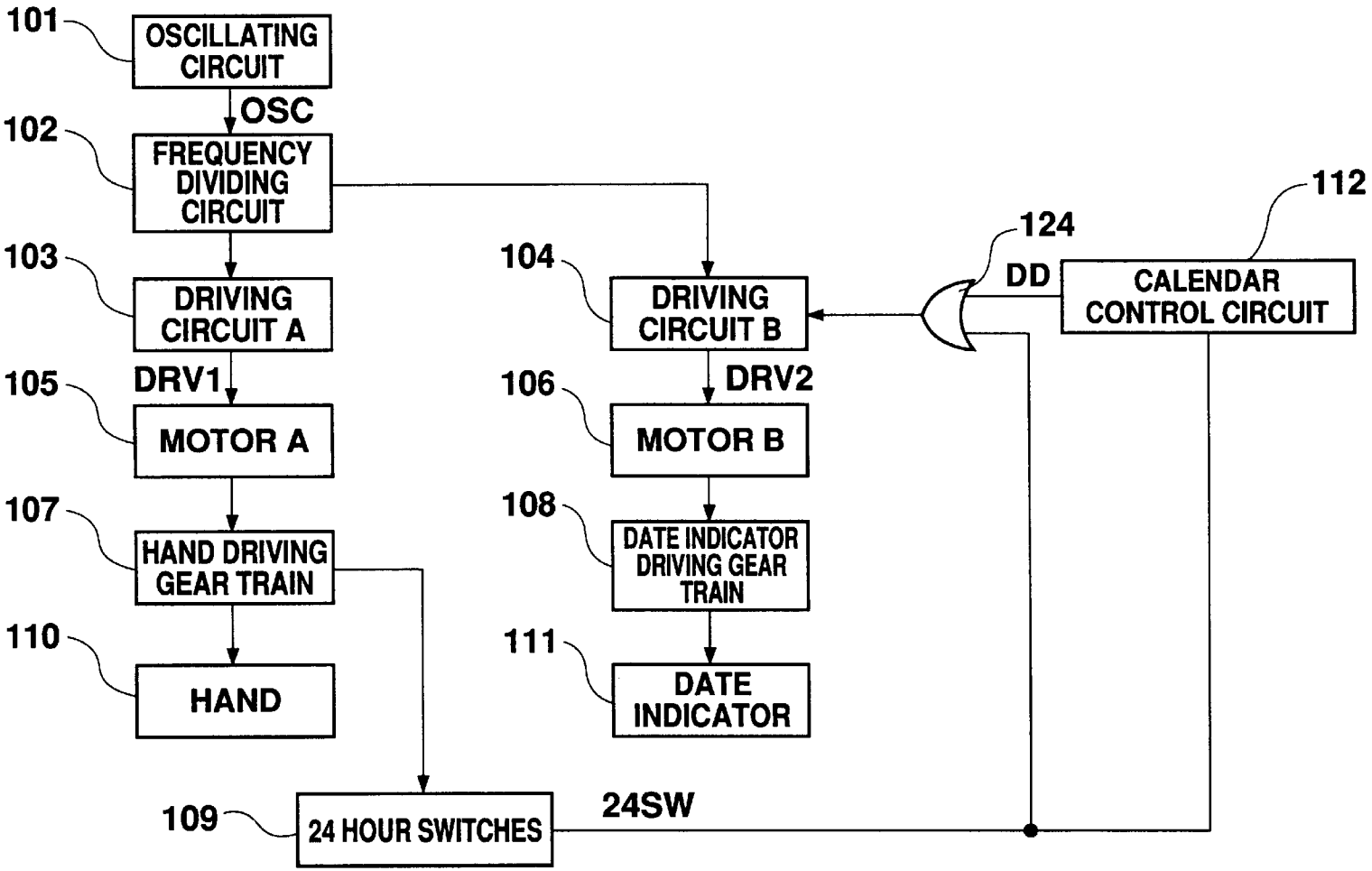
FIG. 10 is a block diagram showing a system structure of a conventional timepiece having a calendar.
Figure 11:
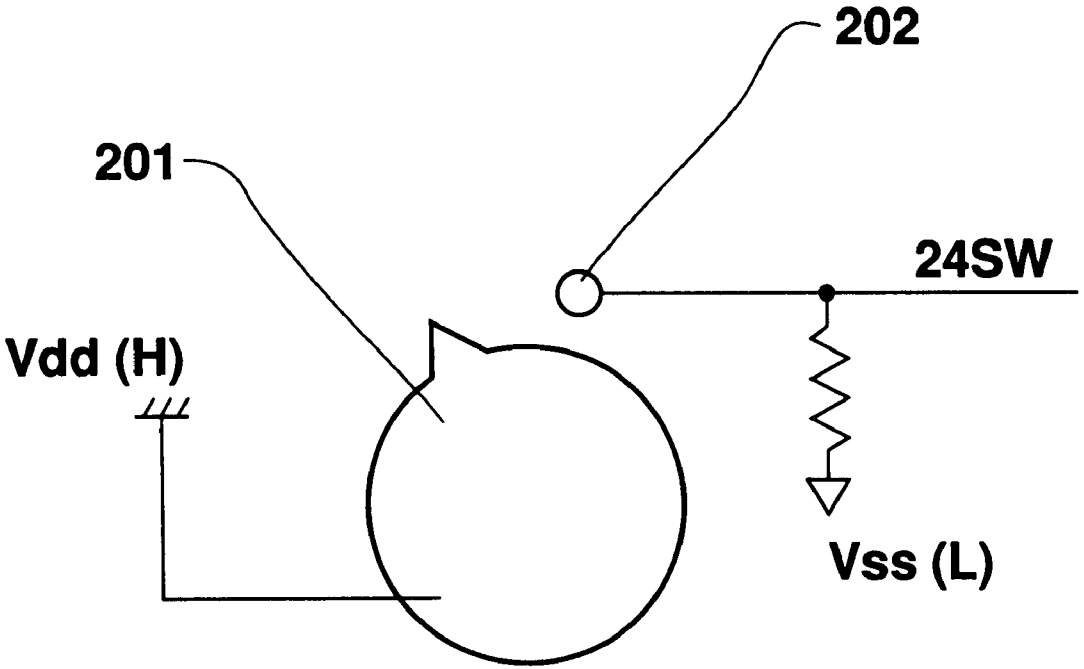
FIG. 11 is a structural diagram showing a conventional 24 hour switch.

In the initial state in FIG. 9, the signals 24SW_A, 24SW_B, and 24SW_C show the "L" level. The level of these signals is retained by the output from the NOR circuits 307, 308, and 309.

When the 24 hours wheel 201 closes the contact A 203, the signal SW_A becomes the "H" level. As a result, the output of the NOT circuit 304 becomes the "L" level, and further, the output of the NOR circuit 307 becomes the "H" level. Therefore, even if the contact A 203 is connected to the "H" level through the 24 hour wheel, unnecessary current does not flow because the output of the NOR circuit 307 is also the "H" level.

When the switch wheel 201 is rotated to open the connection of the switch wheel 201 and the contact A 203, the signal 24 SW_A is maintained in the "H" level by the output of the NOR circuit 307.

When the 24 hour wheel 201 closes the contact B 204, the signal SW_B becomes the "H" level. As a result, the output of the NOT circuit 305 becomes the "L" level, and, further, the output of the NOR circuit 308 becomes the "H" level. On the other hand, since the output of the OR circuit 301 becomes the "H" level, the output of the NOR circuit 307 becomes the "L" level. Accordingly, the signal 24SW_A becomes the "L" level.

When the 24 hour wheel 201 closes the contact C 205, it operates in the same manner as described above.

Thus, as the switch circuit of the 24 hour switches includes the constitution shown in FIG. 8, switch current does not flow while the 24 hour wheel 201 closes the contact A 203, the contact B 204, or the contact C 205. Accordingly, power consumption is reduced.

Figure 12:
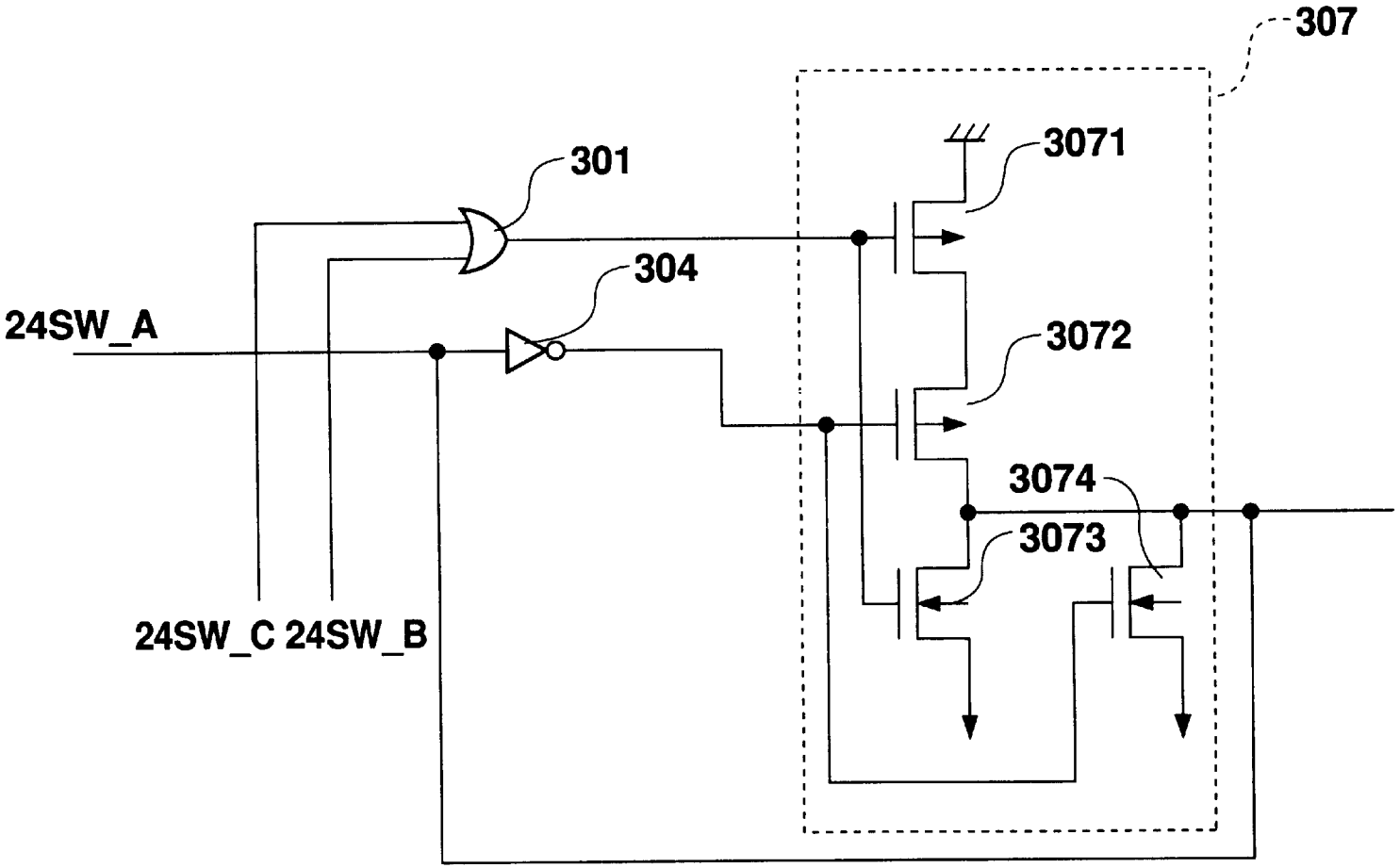
FIG. 12 is a diagram showing a part of FIG. 8.

Here, a switch input circuit constructed as shown in FIG. 8 will be described in detail. FIG. 12 is a diagram showing a part of FIG. 8 with the NOR circuit 307, decomposed to the level of a transistor. In FIG. 12, 3071 and 3072 indicate a P-channel MOS transistor (hereinafter abbreviated as P-Tr), and 3073 and 3074 indicate an N-channel MOS transistor (hereinafter abbreviated as N-Tr). In the explanation of FIG. 12, the timing chart of FIG. 9 is referred to.

When a signal 24SW_A, a signal 24SW_B, and a signal 24SW_C are at the "L" level in the initial state, in which the signal 24SW_A is at the "L" level, the gate voltage of the N-Tr 3074 is at the "H" level, and the N-Tr 3074 remains in the ON state, a signal 24SW_A is fixed at the "L" level via the N-Tr 3074. Similarly, the signals 24SW_B and 24SW_C are fixed at be the "L" level in the OR circuits 308 and 309 in FIG. 8. Their explanation will not be repeated as they have the same structure.

When the 24 hour wheel 201 contacts the contact A203, the signal 24SW_A shown in FIG. 12 becomes the "H" level. As a result, an output of the NOT circuit 304 becomes the "L" level, the N-Tr 3074 comes to be in the OFF state, and the P-Tr 3072 comes to be in the ON state. On the other hand, since the signals 24SW_B and 24SW_C remain at the "L" level, an output from the OR circuit 301 remains at the "L" level. Therefore, since the P-Tr 3071 remains in the ON state and the N-Tr 3073 remains in the OFF state, the signal 24SW_A is connected to the "H" level via the P-Tr 3071 and the P-tr 3072. As a result, unnecessary current does not flow from the 24 hour wheel 201 to the contact A203.

Even if the switch wheel 201 is rotated to be separated from the contact A203, the signal 24SW_A remains at the "H" level. However, when the switch wheel 201 comes to be contact with the contact B204, the signal 24SW_B becomes the "H" level, and an output from the OR circuit 301 becomes the "H" level. As a result, the P-Tr 3071 comes to be in the OFF state, the N-Tr 3073 comes to be in the ON state, and the signal 24SW_A is connected via the N-Tr 3073 to the "L" level. Also, when the signal 24 SW_A becomes the "L" level, the N-Tr 3074 come to be in the ON state and the signal 24SW_A is fixed at the "L" level via the N-Tr 3074. Other signals 24SW_B and 24SW_C are similarly controlled, of which explanation is omitted.

As described above, inputs to the respective switches are connected to the "L" level, which is the first potential, via the N-Tr 3074, which is the first resistive element in a normal state in which the switches remain turned-off. When the switches are turned on, they are connected to the "H" level, which is the second potential, via the P-Tr 3071, which is the second resistive element.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. An electronic analog timepiece provided with a calendar, comprising:

a first motor for driving at least one hand for indicating time;

a switch conjoined with a hand driving gear train driven by said first motor, and turned on at least once in every 24 hour; and a calendar indicating member, the indication of which is updated based on an ON signal of said switch;

wherein said switch is provided with three or more contact groups, each contact is closed in each independent timing according to a rotation of said hand driving gear train, and said calendar indicating member is updated in either an advancing direction or a returning direction according to the order said contacts are closed.

2. An electronic timepiece provided with a calendar according to claim 1, wherein said calendar indicating member is a plate shaped member operated by a second motor operated on the basis of an ON signal of said switch.

3. An electronic timepiece provided with a calendar according to claim 1, wherein said calendar indicating member is a hand operated by a second motor operated on the basis of an ON signal of said switch.

4. An electronic timepiece provided with a calendar according to claim 1, wherein said calendar indicating member is a liquid crystal display operated on the basis of an ON signal of said switch.

5. An electronic timepiece provided with a calendar according to claim 1, wherein said contact groups includes a first contact for controlling said calendar indicating member in said advancing direction, a second contact for controlling said calendar indicating member in said returning direction, and a third contact for detecting a rotative direction.

6. An electronic timepiece provided with a calendar according to claim 5, wherein an arrangement space between said first contact and said second contact is narrower than that of said first contact and said third contact and that of said second contact and said third contact.

7. An electronic timepiece provided with a calendar according to claim 1, wherein said contact includes two or more resistive elements selectively connected to two or more valued power source voltage, an input of said switch is normally connected to a first potential by means of a first resistive element of said power source voltage, said first resistive element does not operate and said second resistive element does operate when said switch is turned on so as to cause said contact to connect to a second potential of said power source voltage via said switch.

8. An electronic timepiece provided with a calendar according to claim 7, wherein said first resistive element operates and said second resistive element of other contacts does not operate when said switch is turned on so as to cause one contact of said contact groups to connect to said second potential of said power source voltage via said switch.

* * * * *